US008192223B2

(12) United States Patent
Bishop

(10) Patent No.: US 8,192,223 B2
(45) **Date of Patent: *Jun. 5, 2012**

(54) CAPPED INSULATION DISPLACEMENT CONNECTOR (IDC)

(75) Inventor: Peter Bishop, Cambs (GB)

(73) Assignee: AVX Corporation, Fountain Inn, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/173,615

(22) Filed: Jun. 30, 2011

(65) Prior Publication Data

US 2011/0256754 A1 Oct. 20, 2011

Related U.S. Application Data

(63) Continuation of application No. 12/820,670, filed on Jun. 22, 2010, now Pat. No. 7,976,334.

(60) Provisional application No. 61/241,211, filed on Sep. 10, 2009.

(51) Int. Cl.
*H01R 4/24* (2006.01)

(52) U.S. Cl. ..... 439/404; 439/395

(58) Field of Classification Search ..... 439/389–396, 439/401–406

See application file for complete search history.

(56) References Cited

U.S. PATENT DOCUMENTS 3,576,518 A * 4/1971 Bazille et al. ..... 439/402
3,854,114 A 12/1974 Kloth et al.
4,068,912 A 1/1978 Hudson et al.
4,153,326 A * 5/1979 Frantz et al. ..... 439/293
4,227,763 A 10/1980 Marks
4,494,813 A * 1/1985 Daley et al. ..... 439/404
4,533,199 A * 8/1985 Feldberg ..... 439/404
4,668,039 A 5/1987 Marzili
4,701,001 A 10/1987 Verhoeven
4,836,803 A 6/1989 Seidel
5,091,826 A * 2/1992 Arnett et al. ..... 361/776

(Continued)

FOREIGN PATENT DOCUMENTS

EP 0 228 750 7/1987

(Continued)

OTHER PUBLICATIONS

Jaycar Electronics Reference Data Sheet: IDCONNJ.PDF (1) "IDC Cable, Headers, & Connectors", 2004.

(Continued)

*Primary Examiner* — Thanh Tam Le
(74) *Attorney, Agent, or Firm* — Dority & Manning, P.A.

(57) ABSTRACT

An electrical insulation displacement connector (IDC) assembly includes a body having at least one channel with an open top side configured for receipt of an insulated conductive core wire therein. A contact element is fixed in the body with a first insulation displacement end defined by opposed blades oriented across the channel, and a second end extending from a bottom surface of the body and configured for electrical contact with a PCB. The IDC assembly includes a cap having a size and configuration so as to engage over the body, with the cap including a recess with an open bottom that is aligned with the body channel in a fitted configuration of the cap on the body. The wires may be initially received in the cap recesses wherein upon pressing engagement of the cap onto the body, the insulated conductive core wire is pressed into the body channel between and into the contact element.

8 Claims, 4 Drawing Sheets

U.S. PATENT DOCUMENTS

| | | | | | |
|---|---|---|---|---|---|
| 5,120,244 | A | | 6/1992 | Saito et al. | |
| 5,188,536 | A | | 2/1993 | Ganthier et al. | |
| 5,199,896 | A | | 4/1993 | Mosquera | |
| 5,478,248 | A | | 12/1995 | Mitra et al. | |
| 5,551,889 | A | * | 9/1996 | Kozel et al. | 439/404 |
| 5,577,930 | A | | 11/1996 | Dahlem et al. | |
| 5,616,047 | A | | 4/1997 | Lutsch | |
| 5,997,337 | A | | 12/1999 | Torii | |
| 6,007,366 | A | * | 12/1999 | Torii et al. | 439/397 |
| 6,019,637 | A | | 2/2000 | Iwata et al. | |
| 6,050,845 | A | | 4/2000 | Smalley, Jr. et al. | |
| 6,093,048 | A | | 7/2000 | Arnett et al. | |
| 6,135,821 | A | | 10/2000 | Liu | |
| 6,135,827 | A | * | 10/2000 | Okabe et al. | 439/731 |
| 6,285,815 | B1 | | 9/2001 | Daoud | |
| 6,338,653 | B1 | * | 1/2002 | Jones et al. | 439/579 |
| 6,827,600 | B2 | * | 12/2004 | Negishi et al. | 439/404 |
| 6,835,089 | B2 | * | 12/2004 | Hayes et al. | 439/404 |
| 6,837,737 | B2 | | 1/2005 | Baier et al. | |
| 7,320,616 | B1 | | 1/2008 | Legrady et al. | |
| 7,833,045 | B2 | | 11/2010 | Bishop | |

FOREIGN PATENT DOCUMENTS

| | | |
|---|---|---|
| EP | 0 411 859 | 2/1991 |

OTHER PUBLICATIONS

HTTP://WWW.ETCO.COM/RELEASES: Press Release:"IDC Terminals Provide One-Step Attachment", 2006.
HTTP://WWW.WPPLTD.DEMON.CO.UK/WPP/WIRING/UKTELEPHONE/INSTALLATION/INSTALLATION.HTML: Tools & Installation: TOLS, Feb. 24, 2008.
EPO Search Report, Dec. 1, 2010.

* cited by examiner

CAPPED INSULATION DISPLACEMENT CONNECTOR (IDC)

RELATED APPLICATION

The present application is a Continuation Application of application Ser. No. 12/820,670, filed Jun. 22, 2010, which claims priority to U.S. Provisional Application Ser. No. 61/241,211, filed Sep. 10, 2009.

FIELD OF THE INVENTION

The present invention relates generally to the field of electrical connectors, and more particularly to a capped insulation displacement connectors (IDC) used to connect one or more insulated wires to a component, such as a printed circuit board (PCB).

BACKGROUND

Insulation displacement connectors (IDC) are well known in the art for forming connections between an insulated wire and any manner of electronic component. These connectors are typically available as sockets, plugs, and shrouded headers in a vast range of sizes, pitches, and plating options. A common feature of IDCs is one or more contact elements incorporating a set of blades or jaws that cut through the insulation around the wire and make electrical contact with the conductive core in a one-step process, thus eliminating the need for wire stripping and crimping, or other wire preparation. IDCs are used extensively in the telecommunications industry, and are becoming more widely used in printed circuit board (PCB) applications.

U.S. Pat. No. 6,050,845 describes an IDC assembly that can be mounted to a circuit board and secured thereto prior to terminating conductors to the connector. The electrical connector includes a housing having at least one conductor-receiving aperture and an associated terminal-receiving passageway extending from a board mounting face and intersecting each conductor-receiving aperture. A terminal is disposed in each terminal-receiving passageway and includes a body portion having a first connecting section extending from one end adapted to be inserted in a through-hole of a circuit board, and a pair of upstanding arms defining an IDC slot for receipt of a wire. Each terminal is partially inserted into the housing in a first position such that a portion of the terminal body and the first connecting section extends below the board mounting face of the housing. Upon positioning the first connecting sections in corresponding through-holes of a circuit board, the terminals can be secured to the board, after which ends of insulated conductors can be inserted into respective conductor-receiving apertures and terminated therein to respective terminals by moving the housing toward the board to a second position against the board and simultaneously pushing all the corresponding wires into respective IDC slots.

Attempts have been made to configure IDCs for surface mounting technology (SMT) applications as well. For example, U.S. Pat. No. 7,320,616 describes an IDC specifically configured for SMT mounting to a PCB. The connector assembly has at least one contact member with a piercing, cutting or slicing end that is slideably disposed within a main body, and a mounting end that extends from the main body and is attached to a printed circuit board using conventional SMT processes. An insulated conductor, such as a wire, cable and/or ribbon, is inserted in a channel in the main body without being pierced by the piercing end of the contact.

When a user pushes down on the top portion of the main body, the contact slides into the channel and pierces the insulated conductor. The top portion of the main body also provides a surface for a vacuum pick-up nozzle in an automated pick-and-place assembly process.

The IDCs in the above cited references are relatively complicated in that they require all or a portion of the main body to be movable or slidable relative to the contacts to make final connection with the wires after ends of the contacts have been inserted into through holes in the PCB or surface mounted to the PCB. In addition, a perception to some in the industry is that IDCs are not well suited for stressful environments wherein the electrical component is subjected to prolonged shock and vibrations because the wires tend to move or pull out of the contact blades.

AVX Corporation having a principal place of business at Myrtle Beach, S.C., USA, provides a discrete wire-to-board IDC (Series 9175/9176/9177) that has provided significant benefits and advantages to IDC applications. This connector is available in various pin configurations and is SMT assembled to a PCB prior to assembly of the wires. A small application hand tool is used to insert the wires into the respective contact slots. This process cuts the insulation and enables the individual wire conductors to form a homogeneous joint.

The present invention provides yet a further improvement to IDC connectors that is particularly suited for (but not limited to) the AVX Series 9175/9176/9177 connectors discussed above.

SUMMARY

Objects and advantages of the invention will be set forth in part in the following description, or may be obvious from the description, or may be learned through practice of the invention.

In accordance with aspects of the invention, an electrical insulation displacement connector assembly is provided that is particularly well suited for connecting one or more insulated conductive core wires to a PCB. It should be appreciated, however, that connectors according to the invention are not limited to this use. The connector includes a body (also referred to in the art as a "molding") formed from any conventional insulator material. The body can take on various shapes and sizes, but generally includes a bottom surface, a top, longitudinally extending sidewalls, and longitudinal ends. The body has at least one channel defined therein with an open top such that a wire can be pressed into the channel from the top side of the connector body.

At least one contact element is fixed in the body. This element includes a first insulation displacement end oriented transversely across the channel. In a particular embodiment, this end is defined by opposed blades or jaws that define a slot or notch for receipt of the insulated wire therein. As understood by those skilled in the art, the slot is dimensioned such that when an insulated wire is pressed into the slot, the blades cut through the insulation and make electrical contact with the wire core. A second end of the contact element extends from a bottom surface of the body and is configured to make an electrical connection with another component. For example, the second end of the contact element may be configured to be pressed into a through-hole element of a circuit board. In another embodiment, the second end may be bent into an electrical contact tail that is configured to be soldered to a corresponding contact pad element on a circuit board. The method and configuration by which the connector is mated to another component is not a limiting factor of the inventive connector.

The connector assembly also includes a cap having a size and configuration so as to engage over the body. The cap includes a recess with an open bottom that is aligned with the body channel in a fitted configuration of the cap on the body. The recess has a shape and configuration such that the insulated core wires may be initially pressed into the cap, with the cap being subsequently pressed onto the connector body. Thus, the cap serves the function of a tool for inserting the wires into the contact elements, for example between the opposed blades or jaws of the elements. The cap also serves to cover and protect the contacts, and to prevent inadvertent removal or pulling out of the wires from the contact elements. The cap also covers and protects the open ends of live wires inserted in the connector assembly.

The connector assembly may also include engaging locking structure operably configured between the cap and body that engages in the fitted configuration of the cap on the body to prevent inadvertent removal of the cap from the body.

In a particular configuration, the body may include opposite longitudinally extending sidewalls, with the channel defined in the side walls. The cap also includes a top and longitudinally extending side walls, with the recess defined in at least one of the cap side walls. With this embodiment, in the fitted configuration of the cap on the body, the cap side walls slide over the body side walls and the recess aligns with the body channel.

The connector assembly may be configured as a through-wire connector wherein a recess is defined in each of the cap side walls such that a wire can pass completely through the connector assembly for any manner of further purpose. In another embodiment, the connector assembly is configured as a wire termination connector, wherein a recess is defined in only one of the cap side walls such that a wire cannot pass through connector assembly.

The engaging locking structure between the cap and body may include any manner of interlocking components. For example, in one embodiment the locking structure includes a resilient shoulder formed on cap that flexes and engages under a ledge formed on the body upon pressing the cap onto the body.

The cap may include any manner of internal structure that serves to press the wires into the contact elements in the body. In a particular embodiment, this structure may be internal ribs that extend downwardly from the cap top between the side walls.

The body member of the connector assembly may include retaining structure that extends into the channel at a location relative to a depth of the blades within the channel such that the insulation portion of a wire that has been inserted into the channel and pressed down into the first end of the contact element is pushed below the retaining structure. The retaining structure thereby prevents the wire from being inadvertently pulled out or dislodging from the contact element, particularly if the connector is used in a high-vibration environment.

The retaining structure may take on various configurations. In one embodiment, the structure defines at least one pinch point at a location along the channel. Multiple pinch points may be provided. For example, the first end of the contact element may be flanked by pinch points defined by the retaining structure. The pinch points may be intermediate the side walls of the connector body, or may be outboard of the side walls.

In a particular embodiment, the retaining structure may include edges that form a V-shaped notch with an open apex aligned with a centerline axis of the channel. The insulation on the wire compresses when the wire in pressed into the channel and is pushed through the open apex. Once below the notch, the insulation "reforms" to essentially its original size and the wire cannot be subsequently pulled back through the apex. The retaining edges may be defined on the outer face of each opposite sidewall of the body such that the channel extends between or is flanked by the retaining edges.

In a particular embodiment, the retaining structure may also include a ledge that extends generally transversely from the outer face of the body side walls.

As mentioned, the body may take on various shapes and sizes. In a unique embodiment, the body has a generally T-shaped cross-sectional profile, and the retaining structure is defined by a V-shaped access in the opposite header portions of the T-shaped profile with the channel defined between the V-shaped accesses. With this embodiment, the locking structure between the cap and body may include a resilient shoulder formed on the cap that engages under a ledge formed on the header portion of said body.

Desirably, the connector is configured for conventional pick-and-place manufacturing processes. In this regard, the body may have at least one surface that is suited as a pick-up surface for vacuum nozzle. For example, an upper surface of the connector body may have sufficient surface area to serve as a pick-up surface. Similarly, the upper surface of the cap may serve as a pick-up surface.

The connector is not limited to any particular number of channels and associated retaining structure. In one embodiment, the connector is a two-wire connector and includes two channels and associated contact elements and retaining structure. The connector may be configured to accommodate three or more wires.

The present invention also encompasses a PCB assembly that includes one or more of the connector assemblies discussed herein. For example, an exemplary PCB assembly may include a printed circuit board having a contact pad or through-hole footprint defined thereon. At least one of the electrical insulation displacement connector assemblies discussed above is mounted on the PCB. The second end of the contact elements extending from the connector body are configured for mating with the footprint on the PCB.

Particular embodiments of the unique insulation displacement connectors are described in greater detail below by reference to the examples illustrated in the drawings.

DETAILED DESCRIPTION

Reference will now be made to embodiments of the invention, one or more examples of which are illustrated in the figures. The embodiments are provided by way of explanation of the invention, and are not meant as a limitation of the invention. For example, features illustrated or described as part of one embodiment may be used with another embodiment to yield still a further embodiment. It is intended that the present invention encompass these and other modifications and variations as come within the scope and spirit of the invention.

Figure 1:
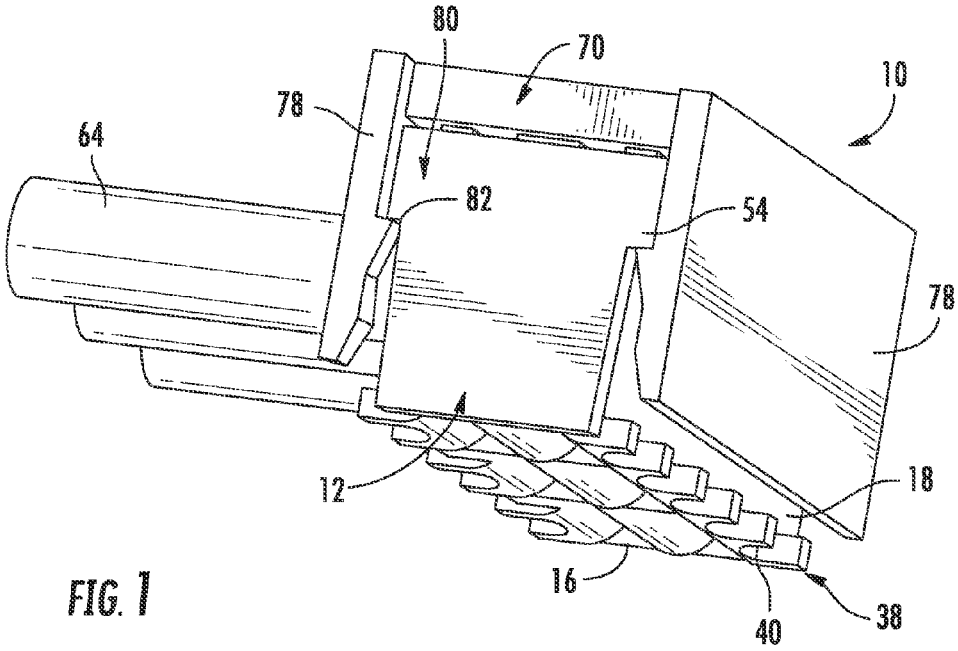
FIG. 1 is a perspective view of an embodiment of a connector assembly according to the invention illustrating the cap mounted onto the connector body.
Figure 2:
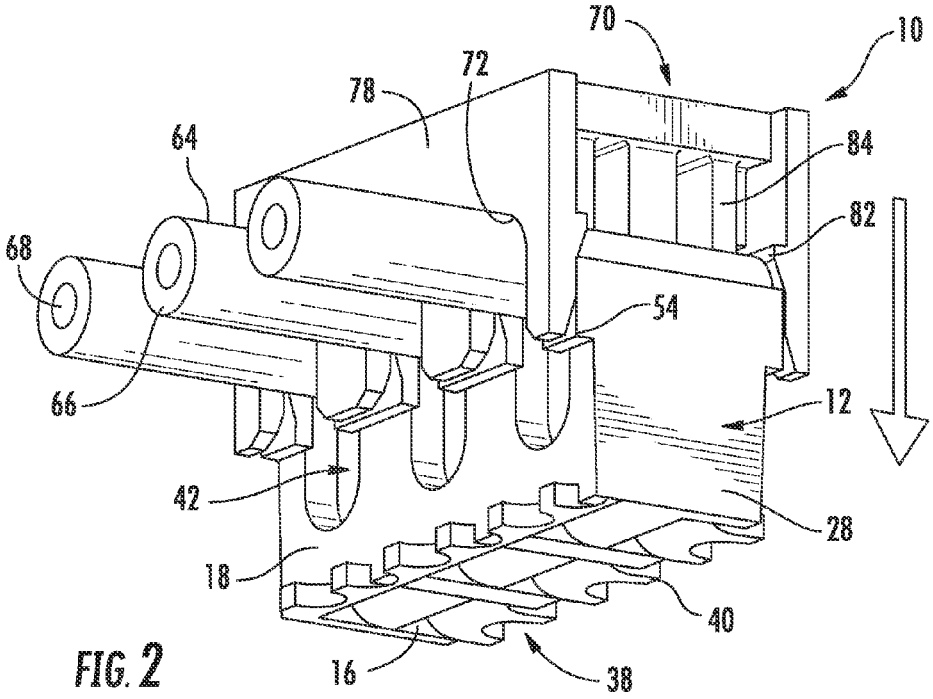
FIG. 2 is a perspective view of the embodiment of FIG. 1 illustrating the cap being pushed onto the connector body.
Figure 3:
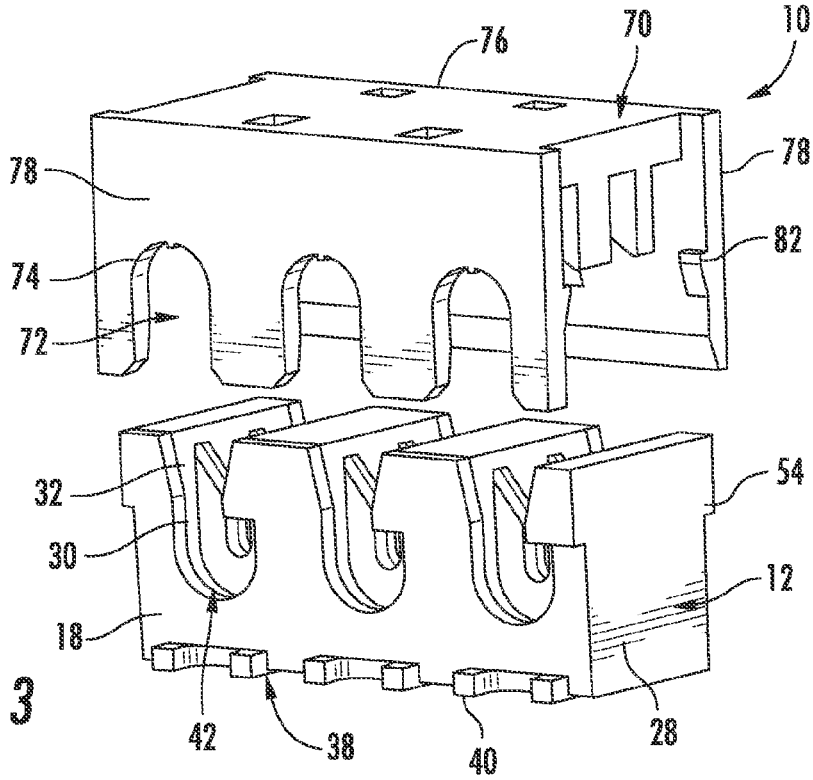
FIG. 3 is a perspective view of the cap and body components of the embodiment of FIG. 1.
Figure 7A:
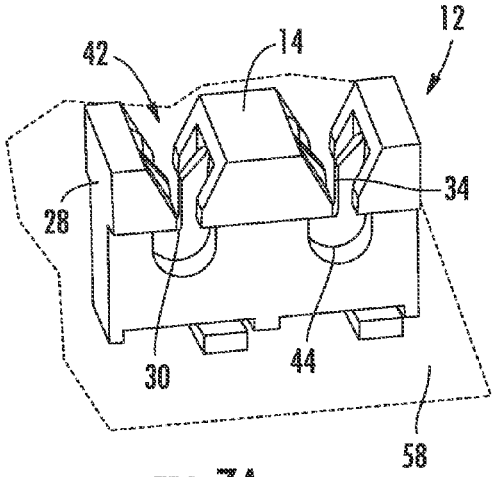
FIGS. 7A through 7D are various perspective views of an embodiment of a connector body.
Figure 7B:
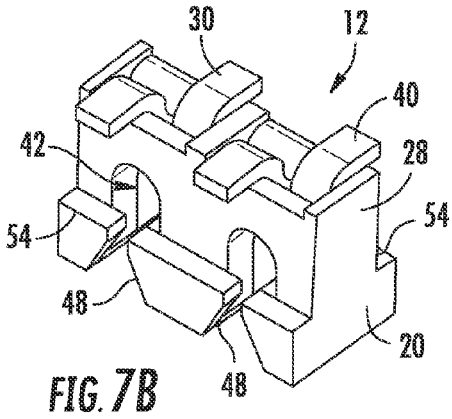
Figure 7C:
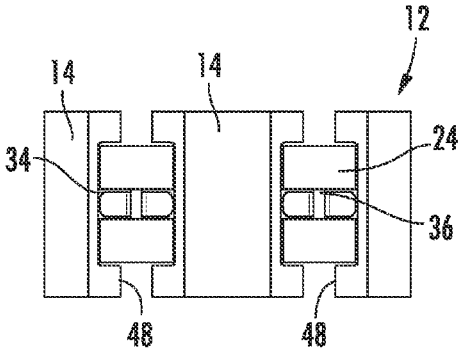

FIGS. 1 through 3 depict a first embodiment of an insulation displacement connector (IDC) connector assembly 10 in accordance with aspects of the invention is illustrated. The connector assembly 10 includes a body 12 configured for mounting on a printed circuit board (PCB) 58 (FIG. 7A) by any conventional mounting technique. The connector assembly 10 also includes a cap member 70 that is configured to be pressed onto the body 12 for initial insertion of conductive core wires 64 into the body 12, and to cover and protect the electrical connection between the wires 64 and body 12, as described in greater detail below. As discussed, the connector assembly 10 in accordance with the invention is particularly well suited for connecting one or more insulated conductive wires 64 to the PCB 58. It should be appreciated, however, that a connector assembly 10 in accordance with the invention is limited to this use.

The body 12 (also referred to as a molding, or insulator) is formed from any conventional insulator material, such as UL94VO Nylon. Other suitable materials are also known in the art. The body 12 can take on various shapes and sizes, but generally includes a bottom 16, a top 14, sides 18, and ends 28. The body 12 has at least one channel 42 defined therein that is configured for receipt of an insulated conductive core wire 64 that is pushed down into the channel 42 from an open top side of the channel. In the embodiments illustrated in the figures, the connector assembly 10 is configured as a 3-wire connector and the body 12 includes three channels 42, with each channel 42 having an open top for receipt of a wire 64, and a bottom 44. In the illustrated embodiment, the channels 42 have a generally U-shaped profile, but are not limited to this particular profile.

Referring to the various figures in general, at least one contact element 30 is fixed in the body 12. The contact element 30 is formed from any suitable electrically conductive material used in the art for connector contact elements, and includes a first insulation displacement end 32 that is oriented transversely across a respective channel 42. This end 32 is uniquely configured for making electrical contact with the conductive core 68 of a wire 64 pushed into the channel 42. In the illustrated embodiments, the end 32 includes opposed blades 34 that define a slot 36 (FIG. 7D) for receipt of the insulated wire therein. The slot 36 is dimensioned such that when an insulated wire 64 of a certain gauge is pressed into the slot, the blades 34 cut through the insulation component 66 and make electrical contact with the wire core 68. Thus, the slot 36 has a width that corresponds generally to the diameter of the conductive core of the wire. In the illustrated embodiments, the blades 34 define a generally U-shaped slot 36. However, this configuration of the blades 34 and slot 36 is not a limiting factor. Various configurations of contact elements used for insulation displacement connectors are known and understood by those skilled in the art, and any one of these configurations may be used in a connector assembly 10 within the scope and spirit of the invention.

A second end 38 of the contact element 30 extends from the bottom surface 16 of the body 12, for example through an opening, slot, or other access in the body 12, and is configured to make an electrical connection with another component, for example a contact pad 60 the printed circuit board 58 (FIG. 7E). The second end 38 may take on various configurations depending on the particular type of electrical connection to be made with the circuit board 58 or other component. For example, the second end 38 of the contact element 30 may be configured as a bayonet, post, or other type of male structure to be pressed into a through-hole connection in the circuit board 58. In the illustrated embodiment, the second end 38 of the contact element 30 is bent or otherwise formed into a tail 40 that is configured to be soldered onto a corresponding contact pad 60 on the circuit board 58. These various types of connections are well known to those skilled in the art and need not be described in detail herein. It should be appreciated that the method and configuration by which the connector body 12 is mated to a circuit board 58 or other component is not a limiting factor of the invention.

In the illustrated embodiments, a single contact element 30 is disposed in each channel 42. In other embodiments no illustrated in the figures, multiple contact elements 30 may be disposed in each of the individual channels 42 of the body 12. In addition, the connector assembly 10 is not limited to any particular configuration or number of contact elements 30. In the illustrated embodiments, the connector assembly 10 is particularly configured for connecting three wires to a circuit board 58 or other component. The body 12 in this embodiment includes three channels 42 with at least one contact element 30 within each channel. It should be appreciated that any number of contact elements 30 and respective channels 42 may be provided in the body 12.

The body 12 includes retaining structure that extends into the channels 42 and serves to ensure that wires 64 pressed into the channels 42 cannot be inadvertently pulled out or dislodged from the contact elements 30. The retaining structure may take on various configurations for this purpose. In the illustrated embodiments, the retaining structure includes edges 48 that extend transversely into the channels 42 at a location relative to a depth of the blades 34 within the channel 42 such that the insulation portion 66 of a wire 64 that has been inserted into the channel 42 and pressed down into the first end of the contact 30 between the blades 34 is pushed below the edges 48.

Figure 7D:
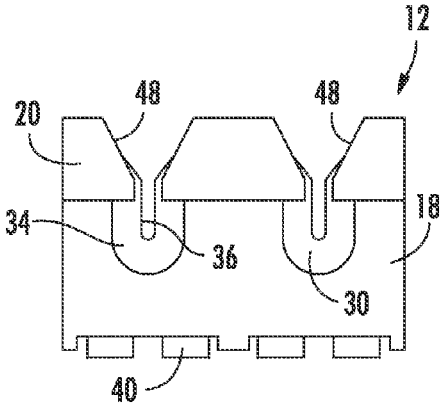
Figure 8:
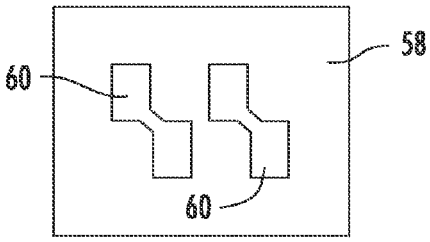
FIG. 8 is a top view of the connector pad footprint on a circuit board to which a connector assembly in accordance with aspects of the invention may be mounted.

In the illustrated embodiment, the edges 48 define a V-shaped notch having an open apex that is generally aligned with a centerline axis of the channel 42, as particularly seen in FIG. 7D. The apex of this V-shaped notch defines a pinch point. The insulation 66 on a wire 64 compresses when the wire is pressed into the channel 42 and is pushed through the open apex. Once below the apex, the insulation 66 essentially "reforms" to its original size, and the wire 64 cannot be subsequently pulled back through the apex or pinch point defined by the edges 48.

The edge configuration may be defined anywhere along the channel 42. In the illustrated embodiment, the retaining edges 48 are defined on the outer face of each opposite side wall 18 of the body 12 such that the channel 42 extends between opposite pinch points or V-shaped notches defined by the retaining edges 48.

The edges 48 may lie in essentially the same plane as the side walls 18, or may extend laterally from the side walls 18 so as to define a ledge 54, as illustrated in the figures. This ledge serves a further function with respect to the cap 70, as described below.

In the various embodiments illustrated in the figures, the contact elements 30 are flanked on each side by a space 24 within the channels 42. These spaces 24 may be desirable in that they allow the insulation portion 66 of the wire 64 to reform along the opposite sides of the contact blades 34 so as to form a seal against the blades 34. This sealing configuration protects the electrical contact between the wire core and contact elements 30 from moisture, humidity, and the like.

The connector assembly 10 also includes a cap 70 that is configured to fit over the body 12. The cap 70 may be formed from the same material as the body 12 and includes a top 76 and side walls 78. At least one recess 72 is defined in one or both of the side walls 78, depending on whether the connector assembly 10 is a through-wire connector or a termination connector. For example, in the embodiment illustrated in FIGS. 1 through 3, the connector assembly 10 is configured as a termination connector in that the wires 64 terminate within the body 12 and do not extend beyond the body 12. In this embodiment, the recesses 72 are defined in only one of the side walls 78, and the opposite side wall 78 is continuous and extends over the channels 42 in the adjacent side 18 of the body 12, as particularly seen in FIG. 1. The number of recesses 72 defined in the cap 70 corresponds to the number of channels 42 in the body 12.

The recesses 72 in the cap 70 have an open end for receipt of the wires 64 and a bottom or closed end 72. The recesses 72 have a shape and configuration such that the insulated core wires 64 may be initially pressed into the recesses and engaged against the closed end 72. The cap 70 (with retained wires 64) may then be pressed onto the body 12. The recesses 72 are aligned with the channels 42 in the body 12 so that when the cap 70 is pressed down onto the body 12, the wires 64 are pressed into the respective channels 42 and into the slot 36 defined between the contact blades 34. Thus, the cap 70 thus serves the function of a tool for inserting the wires 64 into the contact elements 30. The cap 70 also serves to cover and protect the contacts 30, and to prevent inadvertent removal or pulling out of the wires 64 from the contact elements.

The connector assembly 10 may also include engaging locking structure operably configured between the cap 70 and body 12 that engages in the fitted configuration of the cap on the body to prevent inadvertent removal of the cap from the body. The engaging locking structure may include any manner of interlocking components. For example, in illustrated embodiments, the locking structure includes a resilient shoulder 82 formed on the cap 70 that flexes and engages under the ledge 54 formed on the body 12 upon pressing the cap onto the body.

The cap 70 may include any manner of internal structure that serves to press the wires 64 into the contact elements 30 in the body. In the illustrated embodiment, this structure may be internal ribs 84 that extend downwardly from the cap top 76 between the side walls 78, as particularly seen in FIG. 2.

Figure 4:
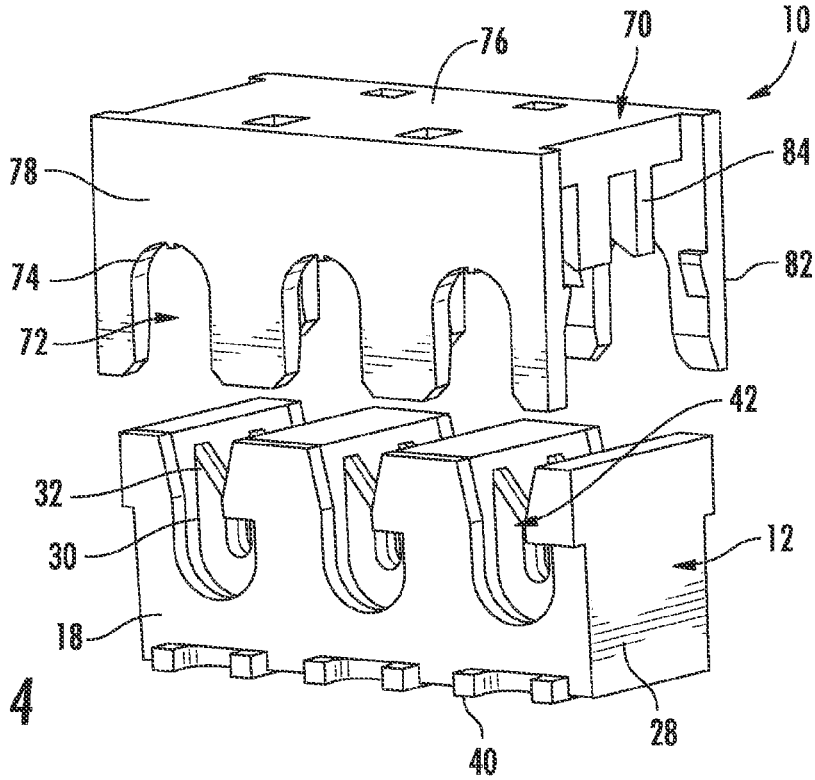
FIG. 4 is a perspective view of the cap and body components of an alternative embodiment of a connector assembly in accordance with aspects of the invention.
Figure 5:
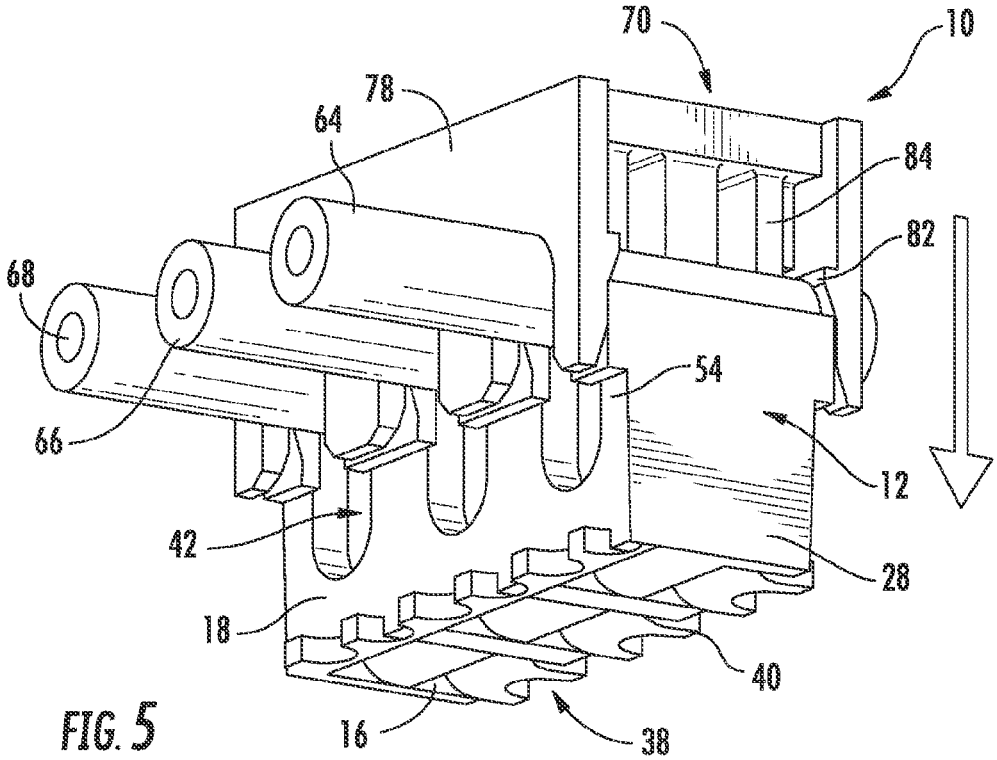
FIG. 5 is a perspective view of the embodiment of FIG. 4 illustrating the cap being pushed onto the connector body.
Figure 6:
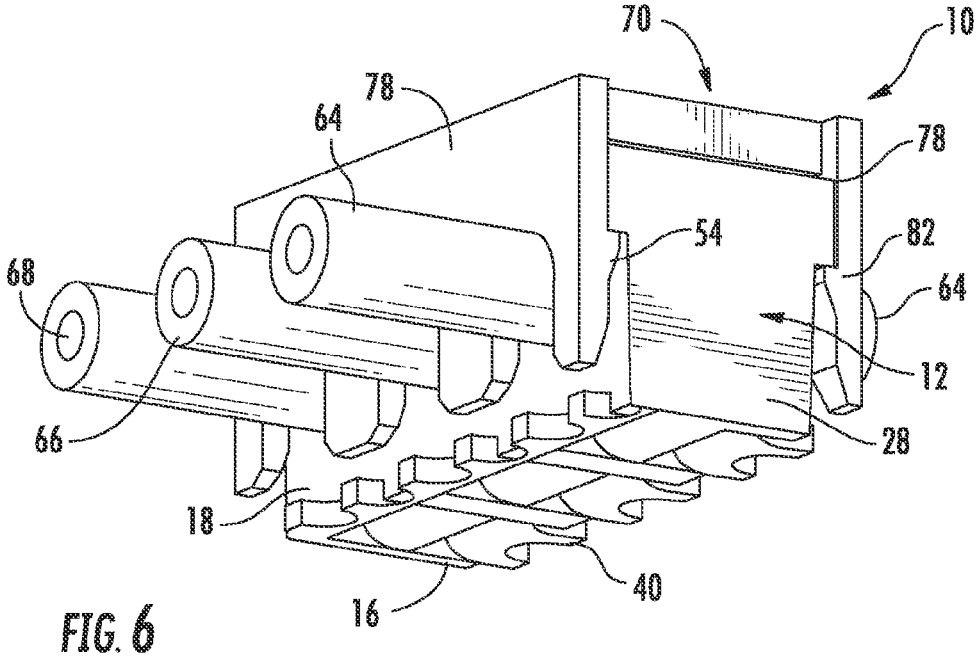
FIG. 6 is a perspective view of the embodiment of FIG. 4 illustrating the cap mounted onto the connector body.

The embodiment of the connector assembly 10 illustrated in FIGS. 4 through 6 is a through-wire connector in that the wires 64 continue through the body 12. In this case, as seen in FIG. 4, recesses 72 are defined in each of the cap side walls 78, which align with the respective channels 42 in each of the body sides 18.

It should be readily appreciated by those skilled in the art that various modifications and variations can be made to the embodiments of the invention illustrated and described herein without departing from the scope and spirit of the invention. It is intended that such modifications and variations be encompassed by the appended claims.

What is claimed is:

1. An electrical insulation displacement connector (IDC) assembly, comprising:

a body having at least one channel with an open top side configured for receipt of an insulated conductive core wire therein;

a contact element fixed in said body with a first end defined by opposed blades oriented across said channel;

a cap having a size and configuration so as to engage over said body, said cap comprising a top wall and longitudinal side walls extending from said top wall;

said cap comprising at least one recess defined in one of said longitudinal side walls that aligns with said channel in a fitted configuration of said cap on said body, said recess having a closed end and an open end for initial receipt of the conductive core wire within said recess;

said cap further comprising an internal structure extending downwardly from said top wall and aligned with said channel in the fitted configuration of said cap on said body;

wherein upon an initial pressing of the conductive core wire into said recess and subsequent engagement of said cap onto said body, the insulated conductive core wire is pressed into said channel between said opposed blades by said internal structure; and an engaging locking structure between said cap and said body that engages in the fitted configuration of said cap on said body to prevent inadvertent removal of said cap from said body, wherein a component of said engaging locking structure is formed along at least one of said longitudinal side walls of said cap.

2. The connector assembly as in claim 1, wherein said internal structure comprises ribs that extend downwardly from said top wall of said cap, said ribs having a size and spaced from said longitudinal side walls of said cap so as to extend into said channel in the fitted configuration of said cap on said body.

3. The connector assembly as in claim 1, wherein said body comprises opposite longitudinally extending sidewalls, said channel defined in said body side walls, said longitudinal side walls of said cap sliding over said body side walls in the fitted configuration of said cap on said body, said engaging locking structure comprising an additional component configured on said body side walls that engages with said component on said longitudinal side walls on said cap.

4. The connector assembly as in claim 1, wherein said connector assembly is configured as a through-wire connector, and further comprising a respective said recess defined in each of said longitudinal side walls of said cap such that a wire can pass through said connector assembly.

5. The connector assembly as in claim 1, wherein said connector assembly is configured as a wire termination connector, a wherein said recess is defined in only one of said longitudinal side walls of said cap such that a wire cannot pass through said connector assembly.

6. The connector assembly as in claim 1, wherein said body comprises retaining structure extending partially across said channel at a location relative to a depth of said blades within said channel such that the insulation portion of a wire inserted into said channel and pressed down between said blades by said cap is pushed below said retaining structure.

7. The connector assembly as in claim 6, wherein said body comprises a generally T-shaped cross-sectional profile, said retaining structure defined by a V-shaped access in opposite header portions of said T-shaped profile, said channel defined between said V-shaped accesses, and wherein said engaging locking structure comprises a resilient shoulder formed on said at least one of said longitudinal sides walls of said cap that engages under a ledge formed on a header portion of said body.

8. The connector assembly as in claim 1, wherein said connector is a multi-wire connector and said body comprises a plurality of said channels, and said cap comprising said internal structure aligned with each of said channels.

* * * * *